US007325895B2

(12) United States Patent
Nakashima

(10) Patent No.: US 7,325,895 B2
(45) Date of Patent: Feb. 5, 2008

(54) PRINTER

(75) Inventor: Atsuhisa Nakashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 358 days.

(21) Appl. No.: 11/089,148

(22) Filed: Mar. 25, 2005

(65) Prior Publication Data

US 2005/0212838 A1 Sep. 29, 2005

(30) Foreign Application Priority Data

Mar. 26, 2004 (JP) ..... 2004-091062

(51) Int. Cl.
*B41J 25/308* (2006.01)

(52) U.S. Cl. ..... 347/8

(58) Field of Classification Search ..... 347/8
See application file for complete search history.

(56) References Cited

U.S. PATENT DOCUMENTS 4,620,807 A 11/1986 Polit
5,274,399 A 12/1993 Uchida et al.
6,343,787 B1 * 2/2002 Kato et al. ..... 271/274
6,799,011 B2 * 9/2004 Abe et al. ..... 399/299
2003/0052957 A1 * 3/2003 Yamada et al. ..... 347/116
2003/0118388 A1 * 6/2003 Sampson et al. ..... 400/579
2005/0140723 A1 * 6/2005 Taira ..... 347/40

FOREIGN PATENT DOCUMENTS

EP A 1 0 705 707 4/1996
JP A 2003-094744 4/2003

* cited by examiner

*Primary Examiner*—Stephen Meier
*Assistant Examiner*—Sarah Al-Hashimi
(74) *Attorney, Agent, or Firm*—Oliff & Berridge, PLC

(57) ABSTRACT

The invention teaches a printer that maintains a gap, between a carrier belt and a printing head that extends for a long distance in a delivery direction of the carrier belt, uniform along the delivery direction, and increases or decreases the uniform gap along the delivery direction. The carrier belt shifts upwards or downwards by a same distance at both ends. The printer includes a printing head, a pair of rollers, a carrier belt, and a moving mechanism. The printing head prints characters or images on a sheet, and is typically an ink jet head. The carrier belt is wound around the pair of rollers. The carrier belt sends the sheet to a printing position opposing the printing head, and sends the printed sheet from the printing position. The moving mechanism includes a mechanism for shifting one of the rollers and a mechanism for shifting the other of the rollers. The rollers are shifted by the same amount.

15 Claims, 9 Drawing Sheets

(a)

(b)

(a)

(b)

(a)

(b)

PRINTER

CROSS-REFERENCE TO RELATED APPLICATION

This application claims priority to Japanese Patent Application No. 2004-091062, filed on Mar. 26, 2004, the contents of which are hereby incorporated by reference into the present application.

BACKGROUND OF THE INVENTION

1. Field of the Invention

The present invention relates to a printer for printing on a sheet.

2. Description of the Related Art

Ordinal printer is provided with a printing head for printing on a sheet of paper or the like, and with a carrier device for delivering the sheet. Ordinal carrier device is provided with a carrier belt wound between a pair of rollers. Using the carrier belt; the sheet of paper or the like is delivered to a printing position opposing the printing head, and is delivered from the printing position.

In order to print sheets with differing thicknesses, a type of printer has been developed that has a device allowing the adjustment of a gap between the carrier belt and the printing head in the printing position.

For example, a printer disclosed in Japanese Laid Open Patent Application Publication 2003-94744 is provided with a carrier belt unit. The carrier belt unit has a carrier belt wound between a driving roller and a driven roller. The carrier belt unit can be swung around a rotary shaft of the driving roller. The gap between the printing head and the carrier belt is increased or decreased by swinging the carrier belt unit around the rotary shaft of the driving roller.

In the conventional printer, the gap between the printing head and the carrier belt is adjusted by swinging the carrier belt unit around the rotary shaft (the rotary shaft of the driving rotor). If the printing head extends for a short distance along a delivery direction of the carrier belt (hereafter shortened to delivery direction), there is no particular problem in adjusting the gap between the printing head and the carrier belt by means of swinging the carrier belt unit.

However, if the printing head extends for a long distance in the delivery direction, this method of adjusting the gap by swinging the carrier belt unit is problematic. In a case of a printer in which a plurality of printing heads is aligned in the delivery direction, the actual distance along which the printing heads extend is long, and the problem of adjusting the gap becomes quite apparent.

When the printing head or heads extend for a long distance in the delivery direction and the gap between the printing head and the carrier belt is adjusted by swinging the carrier belt unit, a portion of the gap at a predetermined distance from the center of swinging can be adjusted to a determined value. However, the gap cannot be adjusted to the determined value at locations which do not have the same distance relationship with respect to the center of swinging. In the conventional printer, the carrier belt unit cannot be moved in a parallel manner, and consequently the gap cannot be maintained uniform when the printing head or heads extend for a long distance in the delivery direction.

In a color ink jet printer, for example, four ink jet heads are aligned in the delivery direction. A technique is required for adjusting the carrier belt position so that the gap between the carrier belt and each of the ink jet heads is maintained uniform, and this uniform gap can be increased or reduced.

BRIEF SUMMARY OF THE INVENTION

The present invention proposes a printer that maintains the gap, between the carrier belt and the printing head that extends for a long distance in the delivery direction of the carrier belt, uniform along the delivery direction, and increases or decreases the uniform gap along the delivery direction. The carrier belt shift upwards or downwards by a same distance at both ends.

The carrier belt needs not move in a parallel manner while a gap adjusting mechanism (or a moving mechanism) is operating. If the carrier belt is shifted into a parallel position from a starting position when the gap adjusting mechanism completes operation, the gap between the carrier belt and the ink jet head can be maintained uniform along the delivery direction.

A printer of the present invention comprises a printing head, a pair of rollers, a carrier belt, and a moving mechanism. The printing head prints characters or images on a sheet opposing the printing head, and is typically an ink jet head, but could also be a thermal printing head or a dot printing head. The carrier belt is wound around the pair of rollers. The carrier belt sends the sheet to a printing position opposing the printing head, the sheet is printed at the printing position, and the carrier belt sends the printed sheet from the printing position. The moving mechanism shifts the pair of rollers by the same amount in a direction orthogonal to the delivery direction of the carrier belt. In the present specification, this process of shifting the pair of rollers is termed 'changing the height' of the rollers. The moving mechanism may not only change the height of the rollers, but may simultaneously also move the rollers in the delivery direction of the carrier belt. As long as the moving mechanism shifts or moves the rollers in the direction orthogonal to the delivery direction of the carrier belt (that is, it changes the height of the rollers), the moving mechanism may simultaneously shift or move the carrier belt in the delivery direction. The moving mechanism changes the height of the pair of rollers by the same distance before and after the operation of the moving mechanism. It is not required to maintain the pair of rollers at the same height as always. Naturally, it is possible that the height of the rollers is maintained at the same height at every instance, and this is the preferred option.

By providing the moving mechanism, it is possible to increase or decrease the gap between the printing head and the carrier belt so that the gap corresponds to the printing quality of the sheet, or corresponds to a change in the thickness of the sheet that is to be printed. Moreover, the gap between the printing head and the carrier belt can be increased or decreased so as to be uniform along the delivery direction, with respect to the printing head that extends for the long distance in the delivery direction.

The sheet can constantly be maintained parallel to the printing head face, and printing quality can thus be improved. Furthermore, the sheet can be delivered smoothly.

BRIEF DESCRIPTION OF THE DRAWINGS

FIG. 1 shows a state where a gap (g1) is narrow.

FIG. 2 shows a state where the gap (g2) is wide.

FIG. 6(*a*) shows the operation while the driving roller is rotating, and FIG. 6(*b*) shows the operation while the gap is being adjusted.

FIG. 7 (a) shows a state where a second cam member has been raised, and FIG. 7(*b*) shows a state where the second cam member has been lowered.

FIG. 9(*a*) shows a state where the cam shaft has been raised, and FIG. 9(*b*) shows a state where the cam shaft has been lowered.

DETAILED DESCRIPTION OF THE INVENTION

Preferred Embodiments to Practice the Invention

A preferred embodiment to practice the present invention will now be described. In the present embodiment, the present invention has been applied to a color ink jet printer. However, the present invention can also be applied to other types of printers.

Figure 1:
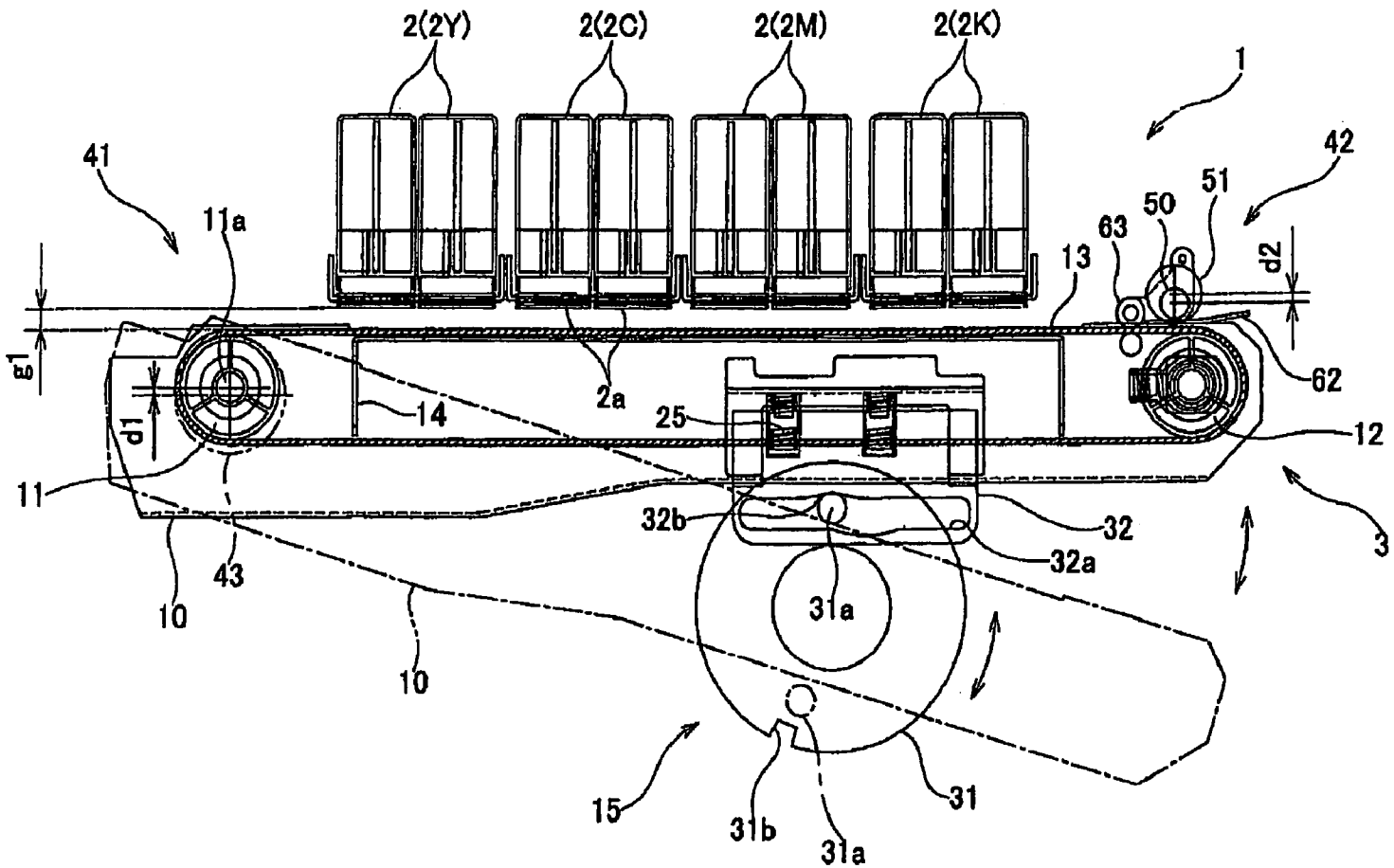
FIG. 1 is a side view of essential parts of an embodiment of an ink jet printer of the present invention.
Figure 2:
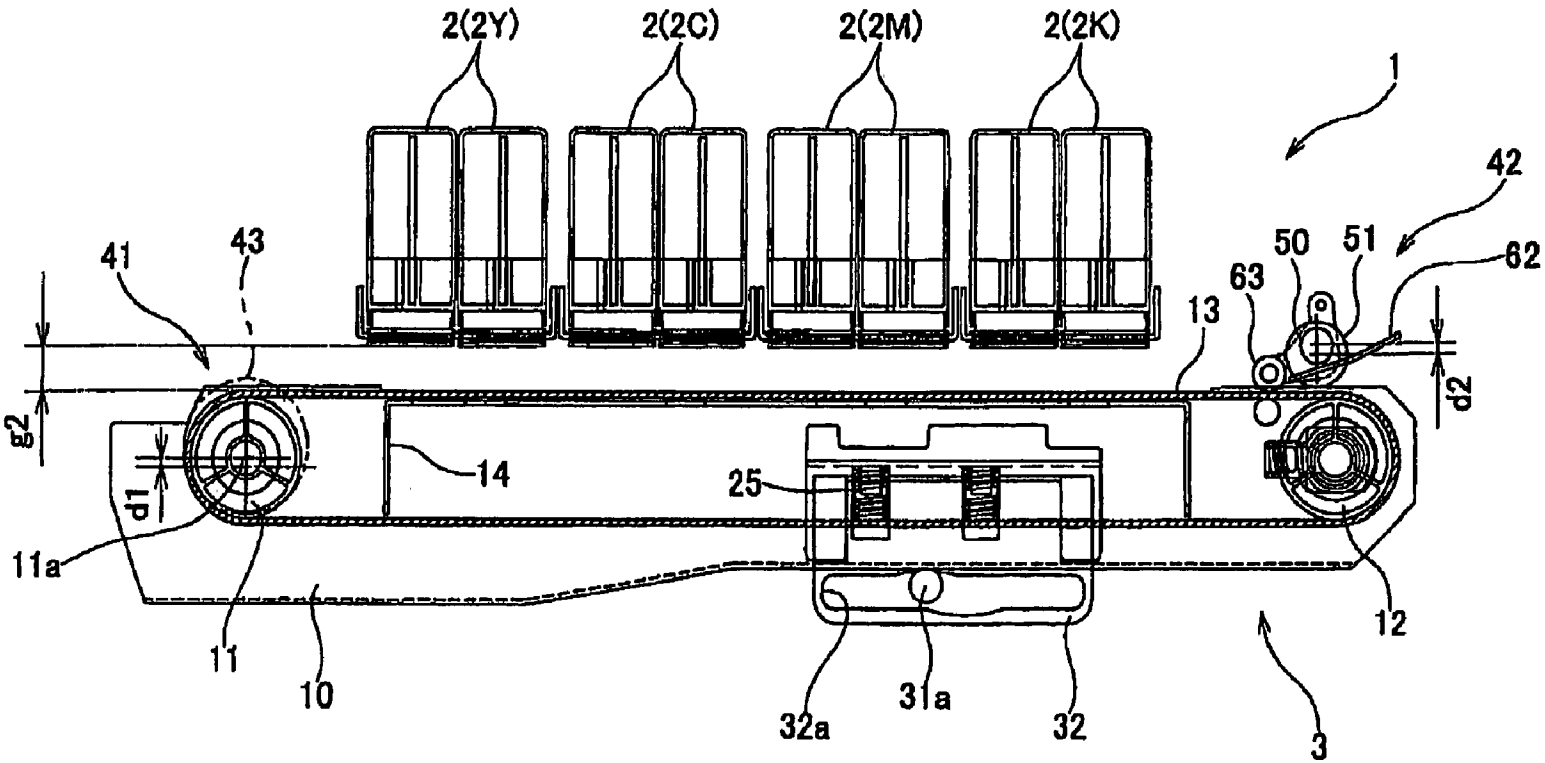
FIG. 2 is a side view of essential parts of the embodiment of the ink jet printer of the present invention.

An ink jet printer 1 shown in FIG. 1 is provided with ink jet heads 2 (2K, 2, 2C, and 2Y) that discharge four colors of ink: black, magenta, cyan and yellow. The ink jet printer 1 is further provided with a carrier unit 3 that carries a sheet of paper below the ink jet heads 2 from a right side of these ink jet heads 2 to a left side thereof. The carrier unit 3 utilizes a carrier belt 13 to deliver the paper. The ink jet printer 1 is provided with a main chassis 30 (not shown in FIG. 1, but shown in FIG. 4) and a belt chassis 10. The ink jet heads 2 are fixed to the main chassis 30. The carrier unit 3 is assembled in the belt chassis 10. The belt chassis 10 can be raised or lowered in a parallel manner with respect to the main chassis 30. FIG. 1 shows a state in which the belt chassis 10 has been raised in a parallel manner with respect to the main chassis 30, and in which a gap g1 between the ink jet heads 2 and the carrier belt 13 has been adjusted so as to be narrow. FIG. 2 shows a state in which the belt chassis 10 has been lowered in a parallel manner with respect to the main chassis 30, and in which a gap g2 between the ink jet heads 2 and the carrier belt 13 has been adjusted so as to be wide. The belt chassis 10 can be swung, with respect to the main chassis 30, from the angle shown by the solid line in FIG. 1 to the angle shown by the dashed line in FIG. 1. The ink jet printer 1 is provided with a parallel adjusting mechanism for adjusting the angle of the belt chassis 10 with respect to the main chassis 30 such that, when the belt chassis 10 is at the angle shown by the solid line in FIG. 1, the gap between the ink jet heads 2 and the carrier belt 13 is uniform with respect to the four ink jet heads 2 (2K, 2M, 2C, and 2Y).

As shown in FIG. 1, the inkjet printer 1 is provided with a total of eight line type inkjet heads 2. The eight line type ink jet heads 2 are fixed to the main chassis 30 (not shown in FIG. 1, but shown in FIG. 4). Two ink jet heads 2K discharge black ink, two ink jet heads 2M discharge magenta ink, two ink jet heads 2C discharge cyan ink, and two ink jet heads 2Y discharge yellow ink. The eight ink jet heads 2 are aligned in a left-right direction of FIG. 1 (the direction of delivery of the paper).

Each of the two ink jet heads 2K, 2M, 2C, and 2Y that discharge identically colored ink are adjacent in the direction of delivery of the paper. Each ink jet head 2 extends in a direction orthogonal to the page of FIG. 1, and extends for a length equivalent to approximately half the width of the paper. Both ink jet heads that discharge identically colored ink are disposed in locations having displacement therebetween in a direction orthogonal to the page of FIG. 1. Viewed from a direction orthogonal to the paper, both ink jet heads 2 that discharge identically colored ink are disposed such that end parts thereof overlap. As a result, the entire width of the paper passing below the ink jet heads 2 can be printed at the same time by using both of the ink jet heads 2 that discharge identically colored ink. The two ink jet heads 2 that discharge identically colored ink have no space therebetween along the width of the paper which would cause a blank area in the printing.

An ink discharging face 2*a* is formed at a lower face of each of ink jet heads 2. A plurality of nozzles (not shown) is formed in each of the ink discharging faces 2*a*. Ink is discharged from each nozzle. The paper passing below the ink discharging faces 2*a* is printed by discharging ink from the nozzles. The paper is in a printing position when facing or opposing the ink discharging faces 2*a*.

The carrier unit 3 is assembled in the belt chassis 10. The belt chassis 10 has a pair of plates disposed in an orthogonal manner with respect to the page of FIG. 1. Driving roller 11 is provided at a left side of the belt chassis 10 between the pair of plates for forming the belt chassis 10. The driving roller 11 is supported by the belt chassis 10 such that the driving roller 11 can rotate freely with respect to the belt chassis 10. Driven roller 12 is provided at a right side of the belt chassis 10 between the pair of plates for forming the belt chassis 10. The driven roller 12 is supported by the belt chassis 10 such that the driven roller 12 can rotate freely with respect to the belt chassis 10. The driving roller 11 and the driven roller 12 extend between the pair of plats for forming the belt chassis 10.

A continuous or endless carrier belt 13 is wound across the driving roller 11 and the driven roller 12. A carrier belt receiving unit 14 supports the carrier belt 13 from below. The carrier belt 13 is mounted on an upper face of the carrier belt receiving unit 14, and the carrier belt receiving unit 14 prevents the carrier belt 13 from bending downwards. The carrier belt receiving unit 14 is fixed to the belt chassis 10. The belt chassis 10 is pushed upwards via the carrier belt receiving unit 14 by compression springs 25 (see FIG. 1). Lower ends of the compression springs 25 are supported by a cam receiving member 32, whose height with respect to the main chassis 30 can be fixed. The structure between the belt chassis 10, the cam receiving member 32, the main chassis 30 and the compression springs 25 will be described later.

Figure 3:
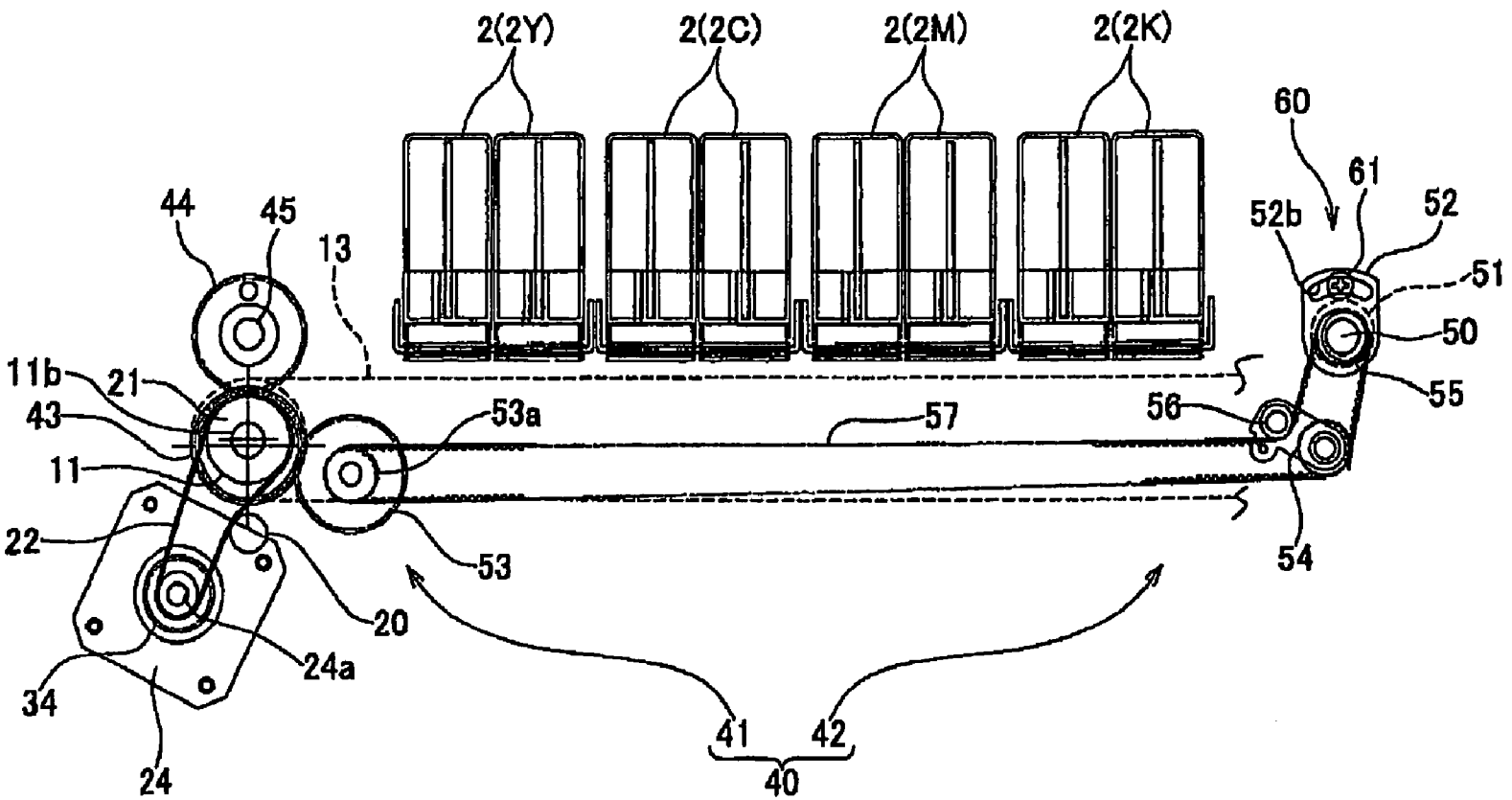
FIG. 3 shows a configuration of a moving mechanism.
Figure 4:
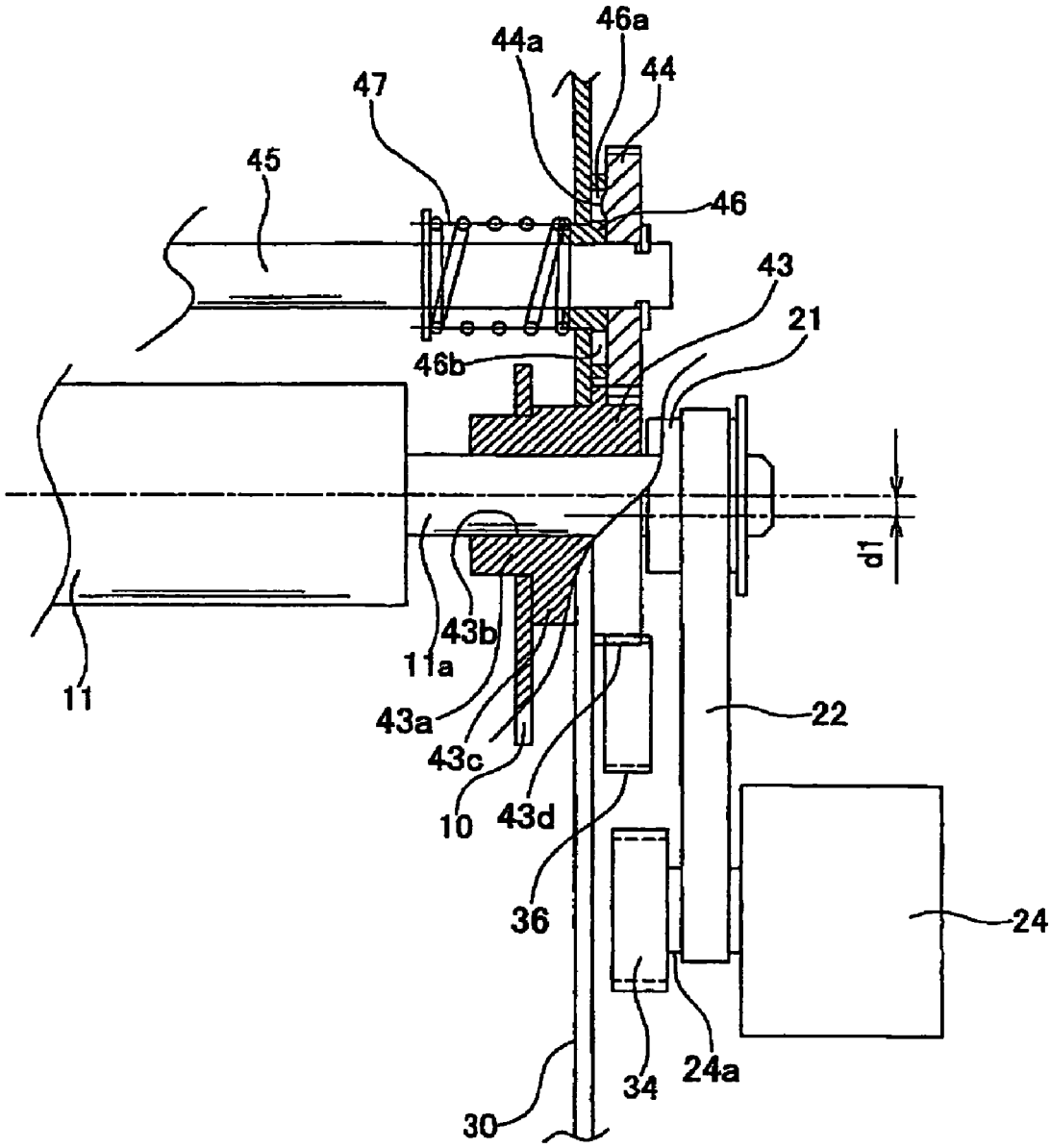
FIG. 4 shows essential parts of a driving system of a driving roller and of the moving mechanism at a driving side.
Figure 5:
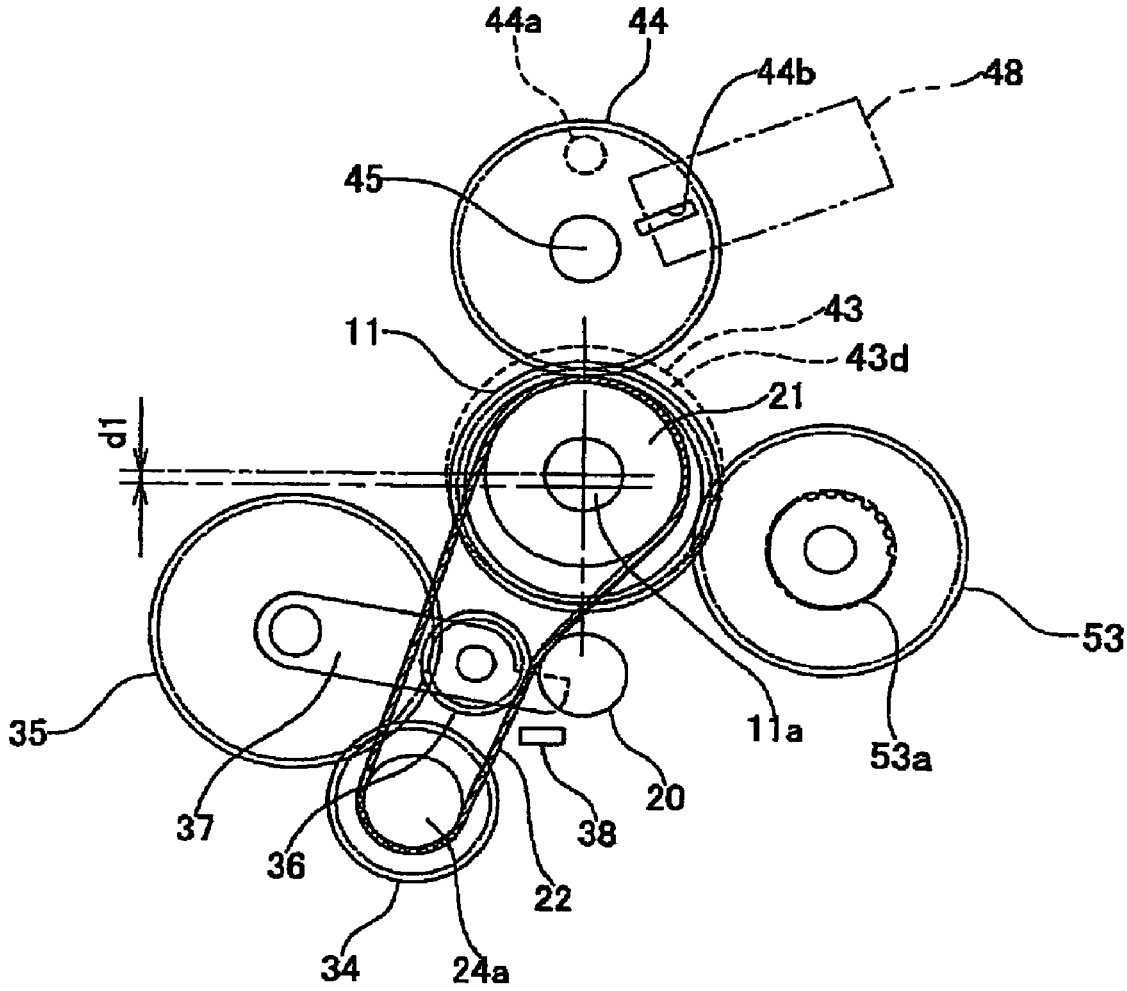
FIG. 5 shows a side view of essential parts of FIG. 4.

First, a mechanism to deliver the carrier belt 13 will be described As shown in FIGS. 3, 4, and 5, a rotary shaft 11*a* of the driving roller 11 is supported such that it can be rotated with respect to the belt chassis 10 by means of a first cam member 43 (to be described). As shown in FIG. 4, the first cam member 43 has two cylindrical portions 43*a*, 43*c* and has a central hole 43*b*. The cylindrical portion 43*a* is supported by the belt chassis 10 and the cylindrical portions 43*c* is supported by the main chassis 10. The center of the cylindrical portions 43*a* is offset from the center of the cylindrical portions 43*c* by a distance d1. The rotary shaft 11*a* of the driving roller 11 is inserted into the central hole 43*b*. The central hole 43*b* is located at the center of the cylindrical portion 43*a*.

A pulley 21 is fixed to an end of the rotary shaft 11*a* of the driving roller 11. As shown in FIG. 3, a pulley 24*a* is fixed to a rotary shaft of a stepping motor 24 used for driving. A carrier belt 22 is wound across the pulleys 21 and 24*a*. A pulley 20 applies tension to the carrier belt 22. The stepping motor 24 used for driving is fixed to the main chassis 30. When the stepping motor 24 rotates, the driving roller 11 rotates, the carrier belt 13 is delivered, and the paper mounted on the carrier belt 13 is delivered towards the left relative to the left-right direction of FIG. 1. The driven roller 12 rotates following the delivery of the carrier belt 13.

The paper is delivered from right to left relative to FIG. 1 through a space (a gap) between the ink discharging faces 2*a* of the ink jet heads 2 and the carrier belt 13. The ink jet printer 1 is capable of printing on sheets of paper of varying thickness, such as plain paper, photographic paper, thick paper or envelopes, etc. It is preferred that there is a short distance from the ink discharging faces 2*a* to a surface of the paper when the paper is thin, so as to increase the accuracy of impact of the ink discharged from the nozzles. This is also the case for printing high quality images on photographic paper, etc. However, for printing plain paper or the like, there is no need for the gap to be narrow when particularly high quality printing is not required. Conversely, it is difficult to deliver the paper in a stable manner if the gap between the ink discharging faces 2*a* and the carrier belt 13 is too narrow. In particular, the paper can readily become jammed when comparatively thick paper such as envelopes, etc. is used.

To deal with this, the ink jet printer 1 is provided with a moving mechanism 40 for adjusting the gap between the ink discharging faces 2*a* of the ink jet heads 2 and the carrier belt 13.

The moving mechanism 40 is provided with a driving side moving mechanism 41 and a driven side moving mechanism 42. The driving side moving mechanism 41 raises or lowers the driving roller 11 with respect to the main chassis 30. The driven side moving mechanism 42 raises or lowers a portion of the belt chassis 10 at the side of the driven roller 12 (the portion at the right side of FIG. 1) with respect to the main chassis 30.

The ink jet heads 2 are fixed to the main chassis 30. Consequently, the gap between the ink discharging faces 2*a* of the ink jet heads 2 and the carrier belt 13 is adjusted when the driving roller 11 and the belt chassis 10 at the side of the driven roller 12 are raised or lowered with respect to the main chassis 30.

The driving side moving mechanism 41 and the driven side moving mechanism 42 are synchronized, and raise or lower the belt chassis 10 with the same timing and to the same extent. The belt chassis 10 is raised or lowered in a parallel manner, with respect to the main chassis 30, by operating the driving side moving mechanism 41 and the driven side moving mechanism 42 in synchrony.

The driving side moving mechanism 41 will now be described. The driving side moving mechanism 41 raises or lowers the driving roller 11 with respect to the main chassis 30. A left end, relative to FIG. 1, of the belt chassis 10 is raised or lowered with respect to the main chassis 30 when the driving roller 11 is raised or lowered with respect to the main chassis 30.

As shown in FIGS. 3 to 5, the driving side moving mechanism 41 has the first cam member 43 and the driving motor 24 that rote the first cam member 43. The driving motor 24 is also used to rotate the driving roller 11 and thus deliver the carrier belt 13.

As shown in FIG. 4, the first cam member 43 is formed from two overlapping cylindrical portions 43*a* and 43*c*, and the centers of the two cylindrical portions 43*a* and 43*c* are mutually offset by a distance d1. A hole 43*b* is formed at a center of the first cylindrical portion 43*a*, and passes through the second cylindrical portion 43*c* at a location offset from its center by the distance d1. The rotary shaft 11*a* of the driving roller 11 passes through the hole 43*b*.

The first cylindrical portion 43*a* is supported such that it can be rotated with respect to the belt chassis 10, and the second cylindrical portion 43*c* is supported such that it can be rotated with respect to the main chassis 30. As shown in FIGS. 4 and 5, cogs 43*d* are formed at an outer periphery of the cylindrical portion 43*c* of the first cam member 43.

A gear 34 is fixed to the rotary shaft of the driving motor 24. A sun gear 35 engages with the gear 34. A planet gear 36 engages with the sun gear 35. The planet gear 36 is supported, such that it can rotate, by a gear arm 37. The gear arm 37 can rotate with the rotational center of the sun gear 35 as its center. The planet gear 36 rotates while revolving around the sun gear 35.

Figure 6:
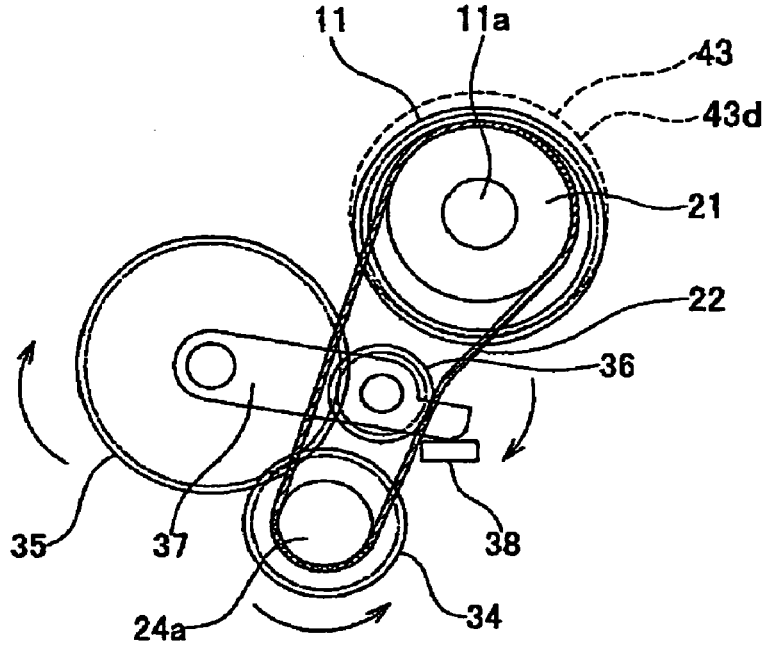
FIGS. 6(*a*) and (*b*) show an operation of the driving system of the driving roller and the driving side moving mechanism.
Figure 6:
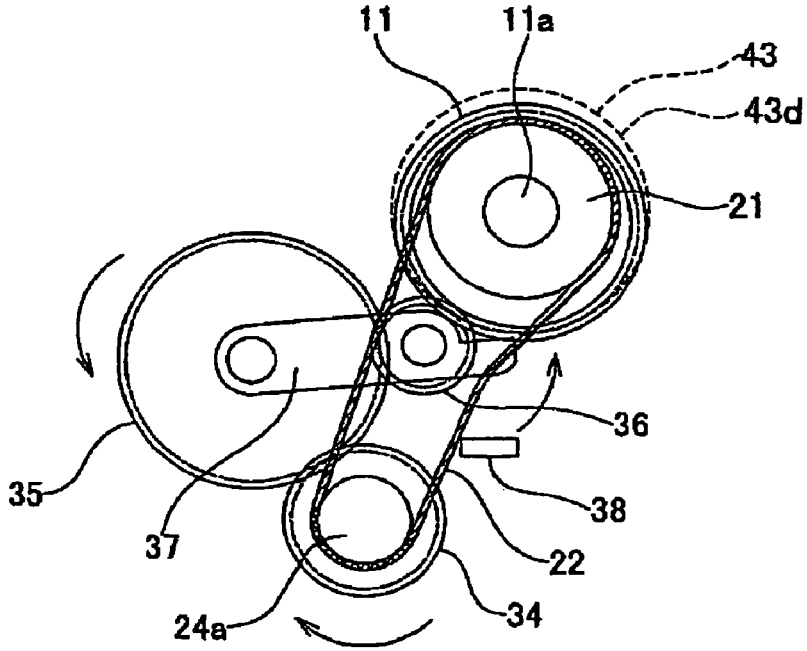

As shown in FIG. 6(*b*), when the gear arm 37 rotates in an counterclockwise direction, the planet gear 36 engages with the cogs 43*d* at the outer periphery of the cylindrical portion 43*c* of the first cam member 43 (this will be described in detail later). Consequently, when the motor 24 rotates, the cylindrical portion 43*c* of the first cam member 43 rotates with respect to the main chassis 30. As described above, the rotational center of the driving roller 11 is offset by the distance d1 from the rotational center of the cylindrical portion 43*c* of the first cam member 43, with respect to the main chassis 30. When the cylindrical portion 43*c* of the first cam member 43 rotates with respect to the main chassis 30, the rotational center of the driving roller 11 moves along a circle having the radius d1 with respect to the main chassis 30.

By this means, the rotational center of the driving roller 11 can be raised and lowered with respect to the main chassis 30 between a position raised by the distance d1 and a position lowered by the distance d1. FIG. 1 and FIG. 4 show a state in which the rotational center of the driving roller 11 is in the position raised by the distance d1 with respect to the main chassis 30, and in which the gap g1 between the ink jet heads 2 and the carrier belt 13 has been adjusted so as to be narrow. FIG. 2 shows a state in which the rotational center of the driving roller 11 is in the position lowered by the distance d1 with respect to the main chassis 30, and in which the gap g2 between the ink jet heads 2 and the carrier belt 13 has been adjusted so as to be wide.

The rotational center of the driving roller 11 does not just move upwards and downwards, but also moves in a horizontal direction. The driven side moving mechanism 42 (to be described) allows horizontal movement of the belt chassis 10. There is no problem if the driving roller 11 is also moving in a horizontal direction.

The driving side moving mechanism 41 is formed at both endes of the driving roller 11, and is a configuration to raise or lower the driving roller 11 such that both ends thereof move in synchrony, with the same timing and to the same extent. Next, the mechanism for achieving this will be described.

The driving side moving mechanism 41 at the further side relative to the plane of the page of FIG. 1 is also provided with a first cam member 43, and is located with the same relationship as in FIG. 4 with respect to the main chassis 30, the belt chassis 10, and the driving roller 11. This differs only in that left and right are the reverse of FIG. 4.

A gear 44 engages with the cogs 43*d* formed at the outer periphery of the cylindrical portion 43*c* of the first cam member 43. The gear 44 at the further side, and a gear 44 at a closer side, relative to the plane of the page of FIG. 1, join with a shaft member 45. Since the gears 44 and the shaft member 45 are fixed, the rotation of the gear 44 at the further side and the gear 44 at the closer side is synchronized. As a result, the first cam member 43 at the further side relative to the plane of the page of FIG. 1, and the first cam member 43 at the closer side, rotate with the same timing and to the same extent. The end of the driving roller 11 at the further side, and the end of the driving roller 11 at the closer side are consequently raised or lowered with the same timing and to the same extent.

In the present embodiment, one single driving motor 24 functions as a motor that rotates the driving roller 11 and thus delivers the paper, and as a motor that rotates the first cam member 43 and raises or lowers the driving roller 11. The number of motors is reduced, and consequently the cost of manufacturing the ink jet printer 1 can be reduced. Below, a mechanism is described whereby the driving motor 24 is used to separately drive the driving roller 11 and the first cam member 43.

As shown in FIGS. 4 and 5, the driving motor 24 and the driving roller 11 are linked by the carrier belt 22. In the case where paper is to be delivered, the driving motor 24 rotates in the counterclockwise direction of FIG. 5. This rotates the driving roller 11 in the counterclockwise direction, and the upper side of the carrier belt 13 shown in FIG. 1 is delivered from right to left. The paper is delivered from right to left.

When the driving motor 24 rotates in the counterclockwise direction of FIG. 5, the sun gear 35 rotates in a clockwise direction, and the gear arm 37 rotates in the clockwise direction. The planet gear 36 separates from the first cam member 43. Consequently the first cam member 43 does not rotate even if the driving motor 24 is rotating so as to deliver the paper, and the driving roller 11 is not raised or lowered.

This state is shown in FIG. 6(*a*). When an output pulley 24*a* of the driving motor rotates in the counterclockwise direction of FIG. 6, driving force of the driving motor 24 is transmitted to the driving roller 11 via the carrier belt 22, and the driving roller 11 is thus driven to rotate. By contrast, the planet gear 36 moves in a clockwise direction along the outer periphery of the sun gear 35, the planet gear 36 disengages from the first cam member 43, and the driving force of the driving motor 24 is not transmitted to the first cam member 43, so that the first cam member 43 is not rotated.

When the planet gear 36 has moved by a certain extent along the outer periphery of the sun gear 35, an end of the gear arm 37 makes contact with a stopper 38, and this prevents the planet gear 36 from further approaching the gear 34. This prevents interference between the planet gear 36 and the gear 34 when the driving roller 11 is rotating (while delivering the paper).

In the case where the driving roller 11 is raised or lowered, the driving motor 24 is rotated in the clockwise direction of FIG. 5. When the driving motor 24 is rotated in the clockwise direction of FIG. 5, the sun gear 35 rotates in the counterclockwise direction, the gear arm 37 rotates in the counterclockwise direction, and the planet gear 36 engages with the first cam member 43. As a result, the first cam member 43 is rotated by the driving motor 24, and the rotary shaft 11*a* of the driving roller 11 moves upwards or downwards. In this case, the driving roller 11 rotates in the clockwise direction, and the upper side of the carrier belt 13 is delivered from left to right. The paper is not present when the driving roller 11 is raised or lowered, and consequently it is not a problem that the carrier belt 13 is rotating in the reverse direction.

This state is shown in FIG. 6(*b*). When the output pulley 24*a* of the driving motor rotates in the clockwise direction of FIG. 6, the planet gear 36 moves in the counterclockwise direction along the outer periphery of the sun gear 35, and the planet gear 36 engages with the first cam member 43. As a result, the driving force of the driving motor 24 is transmitted to the first cam member 43 via the gear 34, the sun gear 35, and the planet gear 36. Thereupon the first cam member 43 rotates, and the rotary shaft 11*a* of the driving roller 11 moves upwards or downwards.

The first cam member 43 is capable of rotating with respect to the rotary shaft 11*a* of the driving roller 11. Consequently, the first cam member 43 should not rotate even when the driving roller 11 is rotating. However, as shown in FIG. 4, the pulley 21 linked with the driving roller 11 is very close to one side of the first cam member 43. There is consequently a risk that, when the driving roller 11 is rotating so as to deliver paper, friction with the pulley 21 may drive the first cam member 43 to rotate. If the first cam member 43 is driven to rotate, the height of the driving roller 11 will be changed.

To deal with this, the driving side moving mechanism 41 has a configuration for preventing the rotation of the first cam member 43 when the driving roller 11 is being driven to rotate by the driving motor 24. A specific description of this configuration is given below.

As described above, the gears 44 engage with the pair of first cam members 43 so as to cause the first cam members 43 to rotate in a synchronized manner. A protruding part 44*a* that protrudes inwards is formed at a portion of an inner face side (the left side in FIG. 4) of the gear 44. The main chassis 30 supports the shaft member 45, via a shaft supporting member 46, such that the shaft member 45 can rotate. The shaft supporting member 46 is fixed to the main chassis 30. Concave members 46*a* and 46*b* are formed in the shaft supporting member 46 at locations having point symmetry with respect to the shaft member 45, and the protruding part 44*a* can engage with these concave members 46*a* and 46*b*. Further, the shaft member 45 and the gear 44 are energized to the left, relative to FIG. 4, by a coiled spring 47. This locking structure is provided only at the side shown in FIG. 4.

When the rotary shaft 11*a* of the driving roller 11 is located in a raised state with respect to the main chassis 30 (in a state where the gap g1 is narrow), as shown in FIG. 1, the protruding part 44*a* is also in a raised position. The gear 44 is attracted towards the main chassis 30 by the energizing force of the coiled spring 47, and consequently the protruding part 44*a* engages with the upper concave member 46*a*, as shown in FIG. 4.

By contrast, when the rotary shaft 1*a* of the driving roller 11 is located in a lowered state with respect to the main chassis 30 (in a state where the gap g2 is wide), the protruding part 44*a* is also in a lowered position. In this case, the protruding part 44*a* engages with the lower concave member 46*b*.

The gear 44 cannot easily rotate when the protruding part 44*a* is engaged with the upper concave member 46*a* or the lower concave member 46*b*. Consequently, it is also difficult for the first cam member 43 to rotate. The protruding part

44*a* of the gear 44 engaging with the first cam member 43, and the concave members 46*a* and 46*b* fixed to the main chassis 30, function as a restraining mechanism. Frictional force with the pulley 21 is thus prevented from causing the rotation of the first cam member 43 when the driving roller 11 is rotating.

Moreover, the energizing force of the coiled spring 47 has a strength such that the engagement of the protruding part 44*a* and the concave members 46*a* and 46*b* is not easily released due to the frictional force between the first cam member 43 and the pulley 21. Moreover, the energizing force of the coiled spring 47 is set to a strength such that, when the first cam member 43 is being rotated, rotational resistance of the first cam member 43 does not become too great—this rotational resistance being caused by the engagement of the protruding part 44*a* and the concave members 46*a* and 46*b*.

As shown in FIG. 5, a notch-shaped detected part 44*b* is formed in the gear 44 that engages with the first cam member 43. By detecting the detected part 44*b* by using, for example, an optical sensor 48, it is possible to detect a reference position of the first cam member 43, i.e., a reference position of the rotary shaft 11*a* of the driving roller 11. Further, the number of driving steps of the driving motor 24 can be amended using the reference position detected by the sensor 48, such that it is possible to cause the first cam member 43 to rotate a determined angle from the reference position, so that the height at which the rotary shaft 11*a* of the driving roller 11 is located (the gap at side of the driving roller 11) can be adjusted.

Changes in the height of the driving roller 11 can be regulated at multiple stages by increasing the number of concave members 46 that engage with the protruding part 44*a*.

Next, the driven side moving mechanism 42 will be described.

As shown in FIG. 3, the driven side moving mechanism 42 has a cam shaft 50 and a second cam member 51. The main chassis 30 supports the cam shaft 50 such that the cam shaft 50 can rotate with respect to the main chassis 30, at an upwards side (the ink jet head 2 side) from the carrier belt 13. The second cam member 51 has a cylindrical shape, and is fixed to the cam shaft 50 with a positional relationship such that the cam shaft 50 passes through the second cam member 51 at a position offset from the center of the second cam member 51 by the distance d1 (see FIGS. 7(*a*) and (*b*)).

As shown in FIG. 3, a pulley 55 is fixed to the cam shaft 50. A gear 53 is provided that engages with the first cam member 43 of the driving side moving mechanism 41 (see FIG. 5). The gear 53 has a pulley 53*a* that rotates integrally therewith A transmitting carrier belt 57 is wound across the pulley 53*a* and the pulley 55 that is fixed to the cam shaft 50. Pulleys 54 and 56 exert tension on the transmitting carrier belt 57. Due to the above, the second cam member 51 fixed to the cam shaft 50, and the first cam member 43 of the driving side moving mechanism 41, rotate with an identical rotation frequency. The pulleys 53*a*, 54, 55, and 56 are capable of rotating with respect to the main chassis 30. The gear 53 has a number of cogs such that, when the first cam member 43 has been rotated by means of the driving motor 24 when the gap is adjusted, the driving roller 11 and the driven roller 12 are raised or lowered by the same extent. As a result, a configuration is formed in which, when the gap is adjusted, the carrier belt 13 that is maintained by the belt chassis 10 is raised or lowered while always being supported in a parallel state with respect to the head faces 2*a*.

Figure 7:
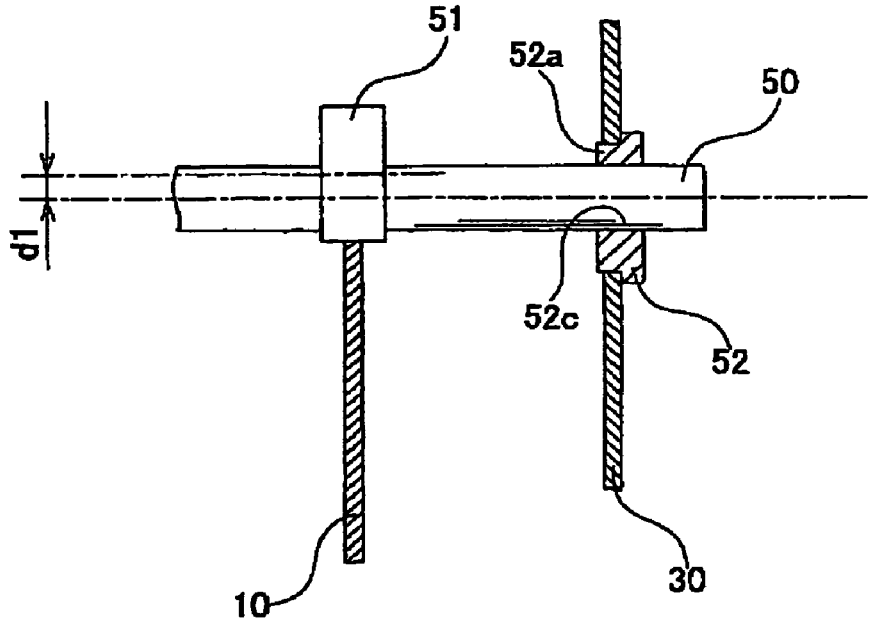
FIGS. 7(*a*) and (*b*) schematically show essential parts of a driven side moving mechanism.
Figure 7:
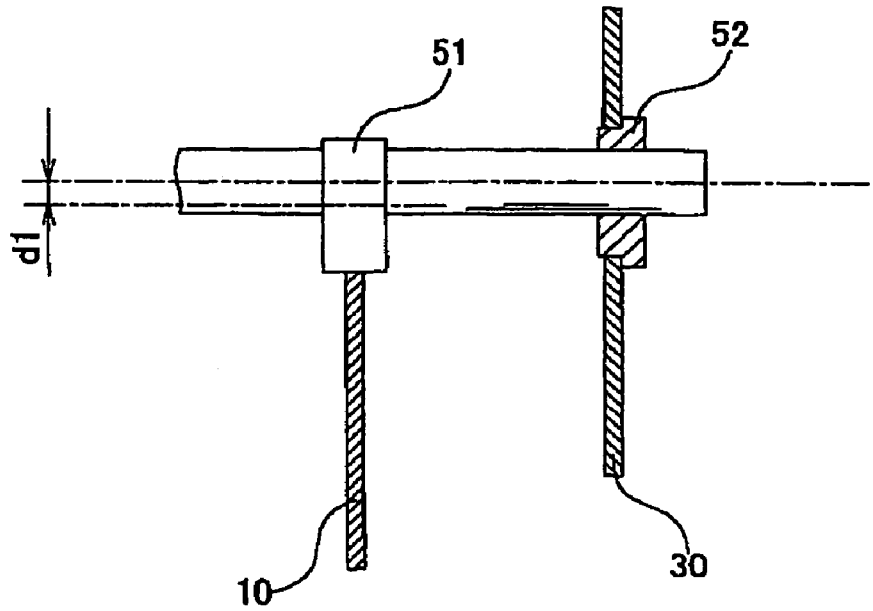

As shown in FIGS. 3 and 7, both ends of the cam shaft 50 are supported by the main chassis 30, via a shaft supporting member 52, such that the cam shaft 50 can rotate. The second cam member 51 is fixed to the cam shaft 50 at both sides of the cam shaft 50. FIG. 3 shows only the second cam member 51 and the shaft supporting member 52 at a closer side relative to the plane of the page. In fact, a second cam member 51 and a shaft supporting member 52 are also present at a further side relative to the plane of the page. As described above, a center of the second cam member 51 is off-center by the distance d1 from the central axis of the cam shaft 50. This distance d1 is identical with the distance d1 between the rotational center of the cylindrical portion 43*c* of the first cam member 43 and the rotational center 11*a* of the driving roller 11.

When the first cam member 43 is rotated by means of the driving motor 24, the cam shaft 50 and the second cam member 51 fixed to the cam shaft 50 also rotate in synchrony with the rotation of the first cam member 43. This alters the height of the lower edge of the second cam member 51. As shown in FIGS. 7(*a*) and (*b*), the height of the lower edge of the second cam member 51 can be raised or lowered between a position raised by the distance d1 from a reference height shown in FIG. 7(*a*), and a position lowered by the distance d1 from the reference height shown in FIG. 7(*b*). This is identical to the distance of upwards or downwards movement of the rotational center 11*a* of the driving roller 11. The height of the lower edge of the second cam member 51 is raised or lowered following the height of the rotational center 11*a* of the driving roller 11.

As shown in FIGS. 1 and 2, the belt chassis 10 is energized upwards, via the carrier belt receiving unit 14, by a plurality of the compression springs 25. As a result, a right end of the belt chassis 10 is pushed upwards so as to make contact with the lower edge of the second cam member 51. When the height of the lower edge of the second cam member 51 changes, the right end of the belt chassis 10 follows it in moving upwards or downwards.

As shown in FIGS. 1 and 4, when the driving side moving mechanism 41 has raised the rotary shaft 11*a* of the driving roller 11 by the distance d1 with respect to the main chassis 30, the driven side moving mechanism 42 raises the right end of the belt chassis 10 by the distance d1 with respect to the main chassis 30, as shown in FIG. 7(*a*). When the driving side moving mechanism 41 has lowered the rotary shaft 11*a* of the driving roller 11 by the distance d1 with respect to the main chassis 30, as shown in FIG. 2, the driven side moving mechanism 42 lowers the right end of the belt chassis 10 by the distance d1 with respect to the main chassis 30, as shown in FIG. 7(*b*).

Since the driving side moving mechanism 41 and the driven side moving mechanism 42 operate in synchrony, the belt chassis 10 can move upwards or downwards while being maintained parallel to the main chassis 30.

The driven side moving mechanism 42 has a parallel adjusting mechanism 60 for adjusting an upper face of the carrier belt 13 such that it becomes parallel to the ink discharging faces 2*a* of the eight ink jet heals 2.

Figure 8:
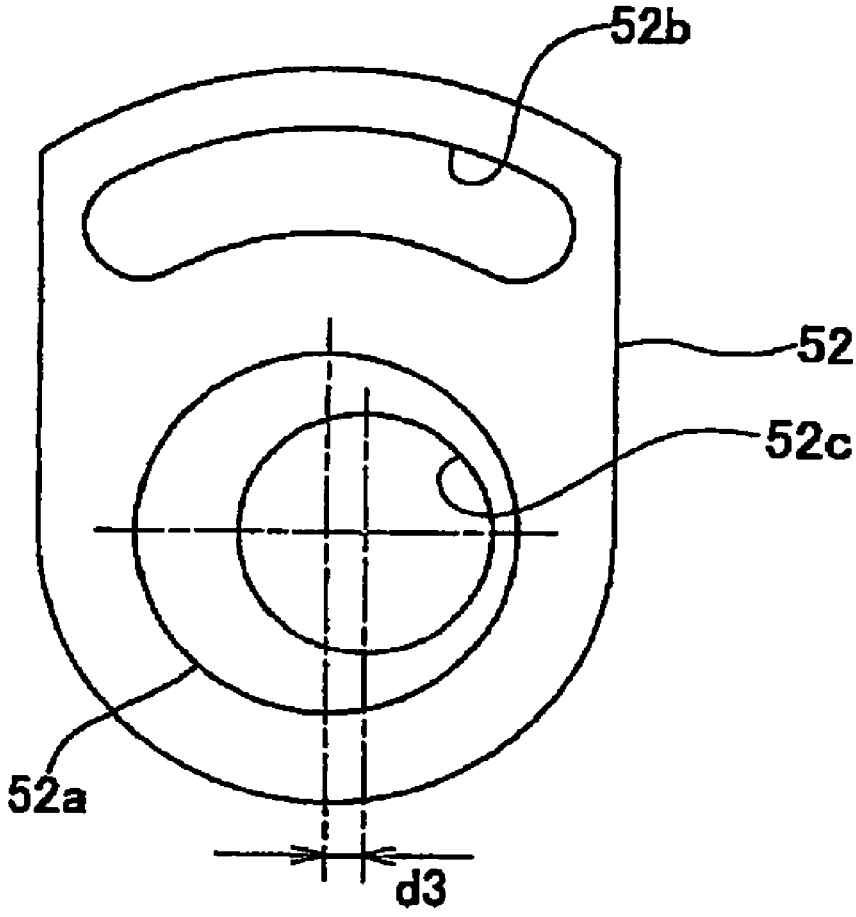
FIG. 8 shows a cam shaft and a cam shaft supporting member.

As shown in FIGS. 7 and 8, a cylindrical portion 52*a* is formed in the shaft supporting member 52 that supports the cam shaft 50. The cylindrical portion 52*a* is supported in the main chassis 30 such that it can rotate. A shaft receiving hole 52*c* through which the cam shaft 50 passes is formed in the cylindrical portion 52*a*. In the state shown in FIG. 8, a rotational center of the shaft receiving hole 52*c* is off-center, in a horizontal direction, by a determined quantity d3 from a rotational center of the cylindrical portion 52*a*.

As shown in FIG. 8, a circular arc-shaped groove 52*b* is formed in an upper edge portion of the shaft supporting member 52. The circular arc-shaped groove 52*b* extends in the direction of rotation of the shaft supporting member 52. The circular arc-shaped groove 52*b* has the same center as the cylindrical portion 52*a* As shown in FIG. 3, a screw 61 is passed through the groove 52*b*, and the screw 61 is tightened to fix the shaft supporting member 52 to the main chassis 30. When the screw 61 is loosened, the shaft supporting member 52 utilizes the cylindrical portion 52*a* to swing, within a vertical plane, with respect to the main chassis 30.

Figure 9:
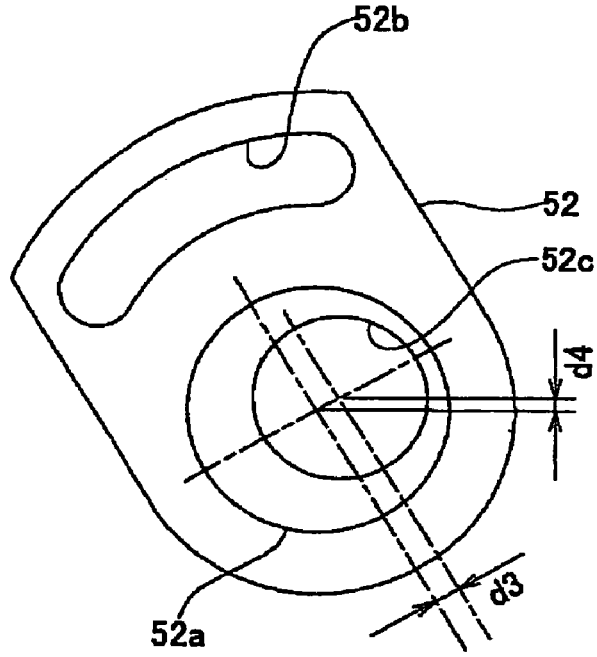
FIGS. 9(*a*) and (*b*) show an operation of the cam shaft and the cam shaft supporting member while adjusting a degree of parallelization.
Figure 9:
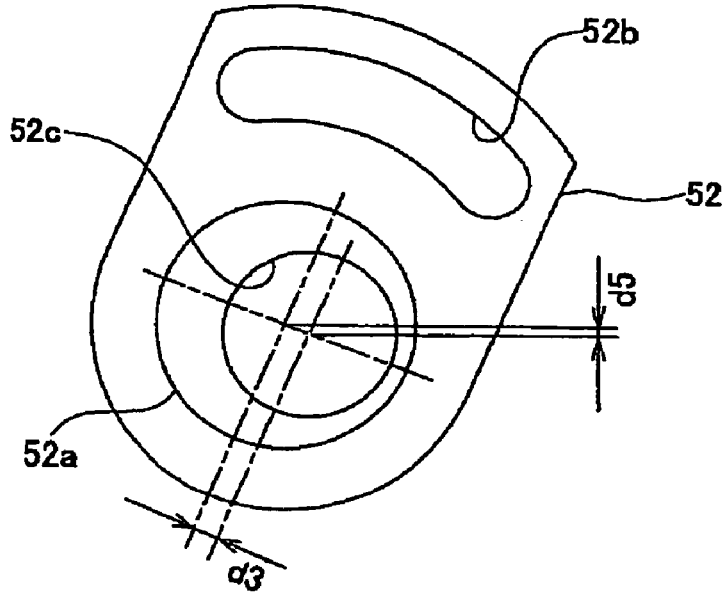

As shown in FIG. 8, the rotational center of the cam shaft 50 is off-center, in a horizontal direction, by a determined quantity d3 with respect to the center of the cylindrical portion 52*a* of the shaft supporting member 52. Consequently, as shown in FIG. 9(*a*), when the shaft supporting member 52 is rotated in an counterclockwise direction with the cylindrical portion 52*a* serving as the center, the cam shaft 50 rises by a determined quantity d4. Conversely, as shown in FIG. 9 (b), when the shaft supporting member 52 is rotated in a clockwise direction, the cam shaft 50 is lowered by a determined quantity d5. In this manner, rotating the shaft supporting member 52 within a vertical plane enables the height (the position along a direction perpendicular to the head faces 2*a*) of the cam shaft 50 to be adjusted such that the height of the driving roller 11 and the height of the cam shaft 50 become identical. The carrier belt 13 can thus be adjusted so that it is parallel to the ink discharging faces 2*a*.

Further, as shown in FIGS. 1 and 2, a guide member 62 and a pressing roller 63 are axially supported in the cam shaft 50. The guide member 62 guides the paper to the ink jet heads 2, and the pressing roller 63 presses, from above, the paper that is being carried to the ink jet heads 2. The guide member 62 and the pressing roller 63 enable the paper to be carried smoothly to the ink jet heads 2. Further, since the guide member 62 and the pressing roller 63 are disposed at the periphery of the cam shaft 50, a more compact configuration of the ink jet printer 1 is possible.

The ink jet printer 1 is provided with a swinging mechanism 15 that swings the belt chassis 10 across a vertical plane with the rotary shaft 1*a* of the driving roller 11 as the center. When maintenance of the carrier unit 3 is required, or paper has jammed within the carrier unit 3, the swinging mechanism 15 is activated to move the carrier unit 3 away from the ink discharging faces 2*a* of the ink jet heads 2.

As shown in FIG. 1, the swinging mechanism 15 comprises a raising and lowering cam member 31, a protrusion 31*a*, a cam receiving member 32, etc. The raising and lowering cam member 31 is supported in the main chassis 30 such that it can rotate. The protrusion 31*a* is formed integrally with the raising and lowering cam member 31. The cam receiving member 32 is movable with respect to the belt chassis 10 in the vertical direction in FIG. 1. A stopper (not shown) is provided with the belt chassis 10, and the stopper prevents from the cam receiving member 32 lowering further with respect to the belts chassis 10. That is, when the cam receiving member 32 is lowered with respect to the main chassis 30, the cam receiving member 32 abuts the stopper, and lowers the belts chassis 10 with respect to the main chassis 30. The cam receiving member 32 has a cam groove 32*a* formed in its lower edge part. The protrusion 31*a* engages with the cam groove 32*a*.

When the raising and lowering cam member 31 and the protrusion 31*a* rotate with respect to the main chassis 30, the cam receiving member 32 is moved upward or downward with respect to the main chassis 30. The belt chassis 10 may be movable vertically with respect to the cam receiving member 32. The belt chassis 10 is pushed upward by the compression springs 25 with respect to the cam receiving member 32.

A motor (not shown) is linked with the raising and lowering cam member 31, and the motor rotates the raising and lowering cam member 31 with respect to the main chassis 30. The protrusion 31*a*, which protrudes in a cylindrical shape perpendicular to a face of the raising and lowering cam member 31 (a direction perpendicular to the face of the page of FIG. 1), is formed at a location that is removed, in a radial direction, from a rotational center of the raising and lowering cam member 31. When the raising and lowering cam member 31 rotates, the protrusion 31*a* moves along a concentric circle of the raising and lowering cam member 31. The lower edge part of the cam receiving member 32 has the cam groove 32*a* formed therein, this extending in the longitudinal direction of the belt chassis 10 (the left-right direction of FIG. 1). The protrusion 31*a* engages with the cam groove 32*a*.

When the raising and lowering cam member 31 rotates, and the protrusion 31*a* moves along the concentric circle of the raising and lowering cam member 31, the cam receiving member 32 changes its height with respect to the main chassis 10.

During printing, the upper face of the carrier belt 13 is maintained such that it has been swung to an angle parallel to the ink discharging faces 2*a* of the ink jet heads 2, as shown by the solid line in FIG. 1. In this position, the compression springs 25 push the belt chassis 10 upwards via the carrier belt receiving unit 14 with respect to the cam receiving member 32. Lower ends of the compression springs 25 are supported by the main chassis 30 through the cam receiving member 32, the protrusion 31*a* and the raising and lowering cam member 31. Since the belt chassis 10 is pushed upward with respect to the main chassis 30, the belt chassis 10 is lifted until the belt chassis 10 abuts the second cam member 51. The upper face of the carrier belt 13 is maintained such that it has been swung to an angle parallel to the ink discharging faces 2*a* of the ink jet heads 2. In the case where paper has jammed, or the like, the cam receiving member 32 is lowed by the rotation of the raising and lowering cam member 31. When the cam receiving member 32 is lowered, it abuts the stopper of the belt chassis 10 and the belt chassis 10 is lowered As a result, the belt chassis 10 is swung downwards, as shown by the dashed line in FIG. 1, thereby removing the carrier unit 3 from the ink discharging faces 2*a* of the ink jet heads 2. It is thus possible to remove the jammed paper.

A concave member 32*b* is formed in the cam groove 32*a*. The concave member 32*b* has a circular arc shape and an upper end thereof is concave. When the belt chassis 10 is in a horizontal state, the cylindrical protrusion 31*a* engages with the concave member 32*b*. The belt chassis 10 is supported by the raising and lowering cam member 31 via the protrusion 31*a*, this preventing the belt chassis 10 from rattling while the paper is being delivered. Further, a notch 31*b* is formed in an outer peripheral portion of the raising and lowering cam member 31 at a determined location along the circumference thereof. A sensor (not shown) attached at the main chassis 30 side of the ink jet printer 1 detects the notch 31*b*. This detection makes it possible to detect the angle of rotation of the raising and lowering cam member 31, i.e., the degree of swinging of the carrier unit 3.

Next, the operation of the ink jet printer 1 will be described.

First, in the case where the paper will be printed using the ink jet heads 2, the output pulley 24*a* of the driving motor 24 is rotated in the counterclockwise direction, the driving force of the driving motor 24 is transmitted to the driving roller 11 via the carrier belt 22, and the driving roller 11 is thus driven to rotate (see FIGS. 1, 5, and 6(*a*)). Thereupon, the carrier belt 13 wound across the driving roller 11 and the driven roller 12 moves, the carrier belt 13 delivers the paper to the ink jet heads 2 from the right side of FIG. 1, and ink is discharged to the paper from the ink jet heads 2. At this juncture, as shown in FIG. 4, the protruding part 44*a* formed on the gear 44 that engages with the first cam member 43, and the concave members 46*a* and 46*b* fixed to the main chassis 30, prevent the rotation of the first cam member 43 that is engaging with the rotary shaft 11*a* of the driving roller 11. Consequently, there is no change in the height of the driving roller 11 during its rotation (while delivering paper).

However, in the case where the type of paper being delivered makes it necessary to change the gap between the carrier belt 13 and the head faces 2*a* of the inkjet heads 2, the driving motor 24 rotates in a clockwise direction (see FIGS. 1, 5, and 6(*b*)). Thereupon, the driving force of the driving motor 24 is transmitted to the first cam member 43, and the first cam member 43 rotates. At this juncture, the rotary shaft 11*a* of the driving roller 11, which is off-center with respect to the rotation of the first cam member 43, moves upwards or downwards, thus allowing the gap at the driving roller 11 side to be adjusted.

Simultaneously, the driving force of the driving motor 24 is transmitted, via the gear 53, the transmitting carrier belt 57, etc., to the cam shaft 50 of the driven side moving mechanism 42. Thereupon, in synchrony with the rotation of the first cam member 43, the second cam member 51 fixed to the cam shaft 50 rotates, and the height of its lower edge changes. Since the belt chassis 10 is energized upwards by the plurality of compression springs 25, the second cam member 51 and the belt chassis 10 are constantly maintained in a contacting state. When the height of the lower edge of the second cam member 51 changes, the portion of the belt chassis 10 at side of the driven roller 12 follows this height change and moves upwards or downwards. Consequently, the gap at the driven roller 12 side is adjusted. At this juncture, the belt chassis 10 is raised or lowered while being maintained parallel to the ink discharging faces 2*a*, and the driving roller 11 and the driven roller 12 are maintained at the same height.

In the case where thin paper, photographic paper, etc. is to be printed, the state is switched to that shown in FIG. 1, in which the gap is narrow. Conversely, in the case where thick paper such as envelopes, etc. is to be printed, the state is switched to that shown in FIG. 2, in which the gap is wide.

The adjustment of the gap, using the moving mechanism 40 described above, can be performed on the basis of information input by an operator concerning paper type, by using a controlling device (not shown) of the ink jet printer 1 to drive the driving motor 24. Alternatively, a sensor can be provided to detect the type of paper delivered to the inkjet heads 2 from a paper supply tray, and the controlling device can drive the motor 24 to adjust the gap on the basis of a signal from the sensor.

In the moving mechanism 40 described above, the driving side moving mechanism 41 raises or lowers a portion of the belt chassis 10 at the side of the driving roller 11, and in synchrony with the driving side moving mechanism 41, the driven side moving mechanism 42 raises or lowers a portion of the belt chassis 10 at the side of the driven roller. Consequently, the gap between the head faces 2*a* and the carrier belt 13 can be adjusted while the carrier belt 13 is being maintained in a parallel state with respect to the head 2*a*. As a result, printing quality can be improved, and paper can be delivered smoothly to the ink jet heads 2.

Next, variants of the above embodiment will be described. Components configured identically to those of the above embodiment have the same reference numbers assigned thereto and a description thereof is omitted.

The motor for rotating the first cam member 43 can be different from the driving motor 24 that rotates the driving roller 11. In this case, a configuration is not required in which the motor for rotating the driving roller 11 and the motor for rotating the first cam member 43 are common, and consequently the configuration of the driving side moving mechanism can be simplified.

The motor for rotating the cam shaft 50 of the driven side moving mechanism 42 may equally well be different from the motor for rotating the first cam member 43 of the driving side moving mechanism 41 (the driving motor 24 in the embodiment described above), and the driving side moving mechanism 41 and the driven side moving mechanism 42 may be synchronized by means for electrically causing the synchronization of these two motors. Furthermore, the driving side moving mechanism 41 and the driven side moving mechanism 42 need not necessarily be made to operate in synchrony. For example, the driven side moving mechanism 42 can raise or lower the belt chassis 10 at the side of the driven roller 12 after the driving side moving mechanism 41 has raised or lowered the belt chassis 10 at the side of the driving roller. That is, it is equally possible for the carrier belt 13 to be made parallel to the head faces 2*a* at a final stage in adjusting the gap.

In the above embodiment, the moving mechanism 40 is a configuration in which the location of the carrier belt 13 can be switched between either a location in which the gap is narrow (see FIG. 1), or a location in which the gap is wide (see FIG. 2). However, a configuration is equally possible in which the location of the carrier belt 13 can be selected from between three or more locations (that is, there are three or more types of gap). Furthermore, in the case where the driving motor is a stepping motor, a configuration is possible in which the gap can be finely adjusted for each of the driving steps of the stepping motor when the gap is being adjusted.

The present invention can be applied to printing heads other than ink jet heads, such as those of a thermal printer, a dot printer, etc.

If the carrier belt 13 is shifted into a parallel position from a starting position, the gap between the carrier belt 13 and the ink jet head 2 is maintained uniform along the delivery direction. The carrier belt 13 needs not move in a parallel manner while the moving mechanism 40 is operating. However, if the carrier belt 13 is maintained in a parallel manner while the moving mechanism 40 is operating, the gap can easily be adjusted as desired. Furthermore, the moving mechanism can easily be simplified. The embodiment of the moving mechanism 40 causes the carrier belt 13 to constantly move in a parallel manner.

It is preferred that the carrier unit 3 has the belt chassis 10 that is separate from the main chassis 30 of the main body of the printer 1.

The use of two chassis 10, 30 simplifies the moving mechanism 40.

A pair of rollers 11, 12 is supported, such that they can rotate, in the belt chassis 10. It is preferred that the moving mechanism 40 is provided with two adjusting mechanisms 41 and 42. One of the adjusting mechanisms 41 changes the height of the rotary shaft 11*a* of one of the rollers. The other adjusting mechanism 42 changes the height, by the same distance, of an end of a belt chassis 10 at the side supporting the other roller 12.

In the case where one of the adjusting mechanisms 41 moves the rotary shaft 11*a*, and the other adjusting mechanism 42 moves the belt chassis 10, the movement of the two mechanism 41, 42 may be independent in the delivery direction, and the configuration of the moving mechanism 40 is thus simplified.

It is preferred that the moving mechanism 41 for shifting the rotary shaft 11*a* shifts the rotary shaft 1*a* of the driving roller 11 of the carrier belt 13. This makes it easier for the driving source for changing the height of the rotary shaft 11*a* of the driving roller 11 to also function as the driving source for driving the carrier belt 13.

It is preferred that a cylindrical portion 43*c* capable of being rotated with respect to the main chassis 30 supports the rotary shaft 11*a* of the driving roller 11, in a manner allowing rotation of the driving roller 11, at a location offset from a rotational center of the cylindrical portion 43*c*. In the present specification, the cylindrical portion 43*c* supporting the rotary shaft 11*a* of the driving roller 11 in this manner is turned the first cam member 43.

In this case, the height of the rotary shaft 11*a* of the driving roller 11 is changed when the first cam member 43 is rotated with respect to the main chassis 30.

It is preferred that the moving mechanism 42 that changes the height of the end of the belt chassis 10 at the side of the driven roller 12 does not restrict the movement of the belt chassis 10 in the delivery direction.

The rotary shaft 11*a* of the driving roller 11 also moves in the delivery direction when the first cam member 43 is rotated with respect to the main chassis 30. If the mechanism for changing the height of the end of the belt chassis 10 at the side of the driven roller 12 does not restrict the movement of the belt chassis 10 in the delivery direction, there will be no inconsistent movement between the two sides.

It is preferred that a motor for rotating the first cam member 43 with respect to the main chassis 30 also functions as a motor causing the rotation of the rotary shaft 11*a* of the driving roller 11. The number of motors required can thus be reduced, and consequently the cost of manufacturing the printer 1 can be reduced.

It is preferred that a restraining mechanism 44*a*, 46*a* and 46*b* is provided that prohibits rotation of the first cam member 43 while the rotary shaft 11*a* of the driving roller 11 is rotating. This prevents a change of position of the driving roller 11 while the driving roller 11 is rotating so as to deliver the sheet.

It is preferred that the moving mechanism 42 that changes the height of the end of the belt chassis 10 at the side supporting the driven roller 12 is provided with the cam shaft 50 and the second cam member 51 in which the distance from the rotating center of the cam shaft 50 to the tip of the second cam member 51 changes in a circumference direction. The moving mechanism 42 directly changes the height of the belt chassis 10 at the side of the driven roller 12, and indirectly changes the height of the driven roller 12. In this case, the degree of change in height of the belt chassis 10 at the side of the driven roller 12 caused by the second cam member 51, the degree of change in height of the driven roller 12 caused by the second cam member 51 and the degree of change in height of the driving roller 11 caused by the first cam member 43 can be made identical, and consequently the belt chassis 10 can be moved in a parallel manner and the driving roller 11 and driven roller 12 changes in height by the same amount.

It is preferred that a motor for causing the rotation of the first cam member 43 also serves as a motor for causing the cam shaft 50 to rotate.

Not only does this reduce the number of motors required and thus reduce the cost of manufacturing the printer, but it also enables the degree of change in height caused by the first cam member 43, and the degree of change in height caused by the second cam member 51 to usually be maintained so as to be identical.

It is preferred that the guiding member 62 for guiding the sheet towards the printing head 2, and the pressing roller 63 for pressing the sheet towards the carrier belt 13, are supported, in a manner allowing rotation, in the cam shaft 50. The printer 1 can have a compact configuration if the guiding member 62 and the pressing roller 63 are disposed at a periphery of the cam shaft 50.

It is preferred that the parallel adjusting mechanism 60 is provided between the main chassis 30 and the cam shaft 50. This parallel adjusting mechanism 60 is capable of changing the height of the cam shaft 50 with respect to the main chassis 30. It is thus easy to adjust the degree of parallelization of the carrier belt 13 with respect to a head face 2*a*.

The invention claimed is:

1. A printer comprising: a printing head for printing on a sheet; a pair of rollers; a carrier belt wound around the pair of rollers, the carrier belt delivering the sheet to a printing position opposing the printing head, and delivering the sheet from the printing position; and a moving mechanism for shifting the pair of rollers by the same distance in a direction in which a gap between the printing head and the carrier belt at the printing position changes.

2. A printer of claim 1, wherein the moving mechanism comprises a first moving mechanism for moving one of the rollers, and a second moving mechanism for moving the other of the rollers.

3. A printer of claim 2, further comprising: a common driving source for driving both the first moving mechanism and the second moving mechanism.

4. A printer of claim 2, wherein the first moving mechanism and the second moving mechanism move the pair of rollers at the same time and by the same amount.

5. A printer of claim 1, wherein one of the rollers is a driving roller, and the other of the rollers is a driven roller, and the moving mechanism comprises a driving side moving mechanism for moving the driving roller, and a driven side moving mechanism for moving the driven roller.

6. A printer of claim 5, wherein a driving motor for driving the driving roller also drives the driving side moving mechanism.

7. A printer of claim 5, wherein a driving motor for driving the driving roller also drives both the driving side moving mechanism and the driven side moving mechanism.

8. A printer of claim 1 further comprising: a main chassis having the printing head fixed thereto, and a belt chassis supporting the pair of rollers and the carrier belt, wherein the moving mechanism comprising a first mechanism for shifting one of the rollers and a second mechanism for shifting the belt chassis at the side of supporting the other of the rollers.

9. A printer of claim 8, wherein the first mechanism comprises a first cam member supported by the main chassis such that the first cam member can rotate with respect to the main chassis, and wherein the roller is supported by the first cam member at a location offset from a rotational center of the first cam member with respect to the main chassis.

10. A printer of claim 9, wherein the roller supported by the first cam member is the driving roller, and a driving motor for rotating the driving roller causes the first cam member to rotate with respect to the main chassis.

11. A printer of claim 10 further comprising: a restraining mechanism for locking the first cam member such that it does not rotate with respect to the main chassis while the driving roller is being driven by the driving motor.

12. A printer of claim 8, wherein the second mechanism comprises: a cam shaft; a second cam member fixed to the cam shaft, and an energizing means for energizing the belt chassis towards the second cam member, wherein the cam shaft is supported by the main chassis such that it can rotate with respect to the main chassis, and the height of an edge of the second cam member can be changed by means of rotation of the cam shaft with respect to the main chassis.

13. A printer of claim 1 further comprising: a main chassis having the printing head fixed thereto, and a belt chassis supporting a driving roller, a driven roller and the carrier belt, a first cam member, a second cam member, and an energizing means for energizing the belt chassis towards the second cam member, wherein the first cam member is supported by the main chassis such that the first cam member can rotate with respect to the main chassis, and the driving roller is supported by the first cam member at a location offset from a rotational center of the first cam member with respect to the man chassis, and the second cam member is supported by the first cam member such that it can rotate with respect to the main chassis, and the height of an edge of the second cam member can be changed by means of rotation of the second cam member width respect to the main chassis.

14. A printer of claim 13, wherein a guiding member for guiding the sheet to the printing position, and a pressing roller for pressing the sheet onto the carrier belt, are supported by a cam shaft for causing the second cam member to rotate.

15. A printer of claim 13 further comprising: a parallel adjusting mechanism, wherein the parallel adjusting mechanism changes the position of the cam shaft with respect to the main chassis by rotation of the parallel adjusting mechanism with respect to the main chassis.

* * * * *